US011834225B2

(12) United States Patent
Lin et al.

(10) Patent No.: US 11,834,225 B2
(45) Date of Patent: Dec. 5, 2023

(54) PACKING BOX AND PACKING METHOD OF HEAT SPREADER

(71) Applicant: Jentech Precision Industrial Co., LTD., Taoyuan (TW)

(72) Inventors: Chin-Long Lin, Taoyuan (TW); Shih-Hung Hsu, Taoyuan (TW)

(73) Assignee: Jentech Precision Industrial Co., LTD., Taoyuan (TW)

( * ) Notice: Subject to any disclaimer, the term of this patent is extended or adjusted under 35 U.S.C. 154(b) by 122 days.

(21) Appl. No.: 17/144,124

(22) Filed: Jan. 7, 2021

(65) Prior Publication Data

US 2022/0081166 A1 Mar. 17, 2022

(30) Foreign Application Priority Data

Sep. 11, 2020 (TW) ..... 109131402

(51) Int. Cl.
*B65D 25/10* (2006.01)
*F28F 99/00* (2006.01)
*B65B 5/06* (2006.01)

(52) U.S. Cl.
CPC ..... *B65D 25/108* (2013.01); *B65B 5/06* (2013.01); *F28F 99/00* (2013.01)

(58) Field of Classification Search
CPC ..... B65D 25/108; B65B 5/06; B65B 5/108; B65B 25/00; F28F 99/00; H05K 7/20; H05K 7/20509; H05K 7/2039; H05K 7/20409; H05K 7/18; H05K 7/14; H05K 7/00
USPC ..... 53/443, 445, 155, 157
See application file for complete search history.

(56) References Cited

U.S. PATENT DOCUMENTS 10,396,414 B2 8/2019 Yeow et al.
2005/0082042 A1* 4/2005 Liang ..... F28F 3/02 165/104.33
2010/0089789 A1* 4/2010 Rosenbaum ..... B65D 75/327 174/250
2010/0224985 A1* 9/2010 Michael ..... H01L 24/83 257/E23.079
2011/0297580 A1* 12/2011 Nelissen ..... B65D 75/327 206/719
2013/0160399 A1* 6/2013 Rosselli ..... B65D 5/5052 53/236
2015/0083638 A1* 3/2015 Corbin ..... H01L 21/67379 53/410
2015/0329257 A1* 11/2015 Elfsberg ..... B65B 61/20 53/410

(Continued)

FOREIGN PATENT DOCUMENTS

CN 205441247 U 8/2016
TW 200927604 A 7/2009

(Continued)

*Primary Examiner* — Anna K Kinsaul
*Assistant Examiner* — Luis G Del Valle
(74) *Attorney, Agent, or Firm* — CKC & Partners Co., LLC

(57) ABSTRACT

A packaging method of heat spreaders includes the following steps. Arrange a plurality of heat spreaders and a plurality of gaskets alternately to a container, wherein at least one of the gaskets is arranged between any immediately-adjacent two of the most adjacent heat spreaders. Remove all of the gaskets from the container at the same time. A packaging box suitable for this packaging method is also provided.

9 Claims, 14 Drawing Sheets

(56) References Cited

U.S. PATENT DOCUMENTS

| | | | | |
|---|---|---|---|---|
| 2016/0054077 | A1* | 2/2016 | Saito | F28F 9/0209 165/173 |
| 2017/0065462 | A1* | 3/2017 | Arnold | A61F 13/15747 |
| 2020/0047967 | A1* | 2/2020 | Sherk, Jr. | B65B 1/04 |

FOREIGN PATENT DOCUMENTS

| | | | |
|---|---|---|---|
| TW | M424304 | U | 3/2012 |
| TW | M605805 | U | 12/2020 |

* cited by examiner

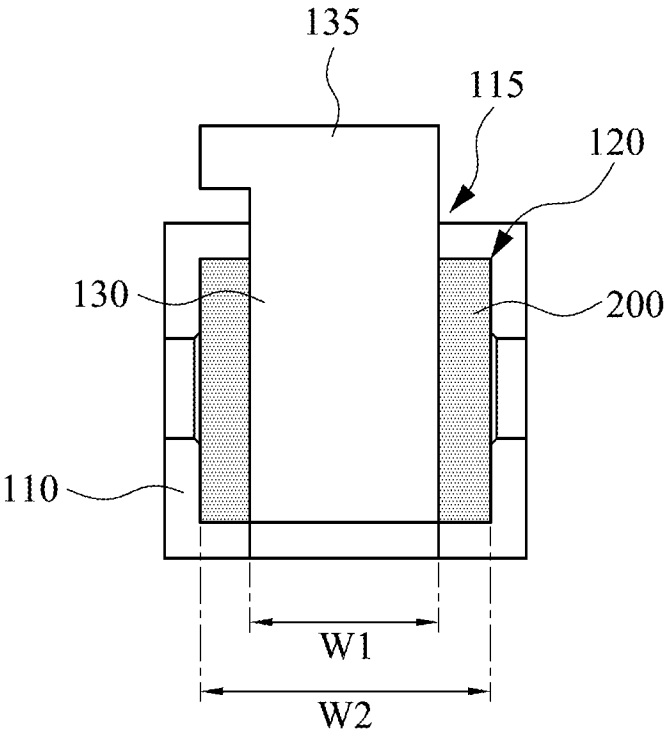
Fig. 1C
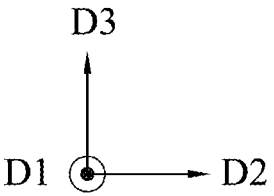

R1

PACKING BOX AND PACKING METHOD OF HEAT SPREADER

RELATED APPLICATIONS

This application claims priority to Taiwan Application Serial Number 109131402, filed Sep. 11, 2020, the disclosures of which are incorporated herein by reference in their entireties.

BACKGROUND

Field of Disclosure

The present disclosure relates to a packaging box and a packaging method, which are used for heat spreaders particularly.

Description of Related Art

With the development of smart phone devices and 5G equipment, the sizes of chips and heat sources have increased, and the demand for heat spreaders responsible for chip heat dissipation has increased. With the automatic loading and unloading requirements of packaging equipment, packaging types have also increased. For example, the packaging types include the trough format, cake box type and tubular stacking packaging, etc. These packaging must pass the transportation test to ensure that they can effectively protect the appearance of the heat spreaders.

Some of the heat spreaders are shipped in a stack to facilitate the subsequent process of setting up heat spreaders. However, the stacking of heat spreaders may cause appearance problems, such as surface scratches, wears and abrasions for the heat spreaders.

SUMMARY

An aspect of the present disclosure is related to a packaging method of heat spreaders.

According to one or more embodiments of the present disclosure, a packaging method of heat spreader includes following operations. A plurality of heat spreaders and a plurality of gaskets are arranged alternately to a container. At least one of the gaskets is arranged between any immediately-adjacent two of the heat spreaders. All of the gaskets are removed from the container at the same time.

In one or more embodiments, each of the gaskets has a handle portion protruding from the heat spreaders. Removing all of the gaskets from the container at the same time further includes following operation. The handle portions protruding from the heat spreaders are clamped to remove all of the gaskets from the container at the same time.

In one or more embodiments, the gaskets are connected to each other to form a unitary spacer.

In some embodiments, arranging the heat spreaders and the gaskets alternately to the container further includes following operations. A first heat spreader of the heat spreaders is placed to the container. An extending portion is provided. A part of the extending portion is aligned with and pushed into an adjacent space near the first heat spreader to form a first gasket of the gaskets, and the part of the extending portion is a part of the unitary space. A second heat spreader of the heat spreaders is placed to the container.

In some embodiments, the spacer has opposite two ends protruding from the container. Removing all of the gaskets from the container at the same time further includes following operation. The unitary spacer is removed through the two ends at the same time, such that the gaskets leave from the heat spreaders at the same time.

In one or more embodiments, the container further includes an opening and a removing port. The handle portions of the gaskets protrude from the container through the opening. The packaging method further includes following operations. The heat spreaders are removed from the removing port after all of the gaskets are removed from the container through the opening.

An aspect of the present disclosure is related to a packaging box.

According to one or more embodiments of the present disclosure, a packaging box includes a container and a plurality of gaskets. The container is configured to accommodate a plurality of heat spreaders. The gaskets are located in the container. The at least one of the gasket is located between immediate-adjacent two of the heat spreaders. Each of the gaskets has a handle portion protruding from the heat spreaders.

In one or more embodiments, the container extends along a first direction, the heat spreaders and the gaskets are arranged along the first direction alternately. The handle portions of the gaskets extend and protrude along a second direction, and each of the gaskets has an L-shape.

In one or more embodiments, the gaskets are extended across the heat spreaders and connected to each other to form a unitary spacer. The unitary spacer has two opposite ends protruding from the container.

In one or more embodiments, the container includes an opening, the handle portions of the gaskets protrudes from the container through the opening. A width of the opening is less than a width of each heat spreader.

In summary, by arranging gaskets on the stacked heat spreaders, damage caused by unexpected contact between the heat spreaders can be avoided. The gasket is designed to be removed at the same time, which can also meet the needs of the subsequent placement process of the heat spreader.

It is to be understood that both the foregoing general description and the following detailed description are by examples, and are intended to provide further explanation of the present disclosure as claimed.

BRIEF DESCRIPTION OF THE DRAWINGS

The advantages of the present disclosure are to be understood by the following exemplary embodiments and with reference to the attached drawings. The illustrations of the drawings are merely exemplary embodiments and are not to be considered as limiting the scope of the present disclosure.

FIG. 1C illustrates a schematic side view of the packaging box of FIG. 1A from another angle;

DETAILED DESCRIPTION

The following embodiments are disclosed with accompanying diagrams for detailed description. For illustration clarity, many details of practice are explained in the following descriptions. However, it should be understood that these details of practice do not intend to limit the present disclosure. That is, these details of practice are not necessary in parts of embodiments of the present disclosure. Furthermore, for simplifying the drawings, some of the conventional structures and elements are shown with schematic illustrations. Also, the same labels may be regarded as the corresponding components in the different drawings unless otherwise indicated. The drawings are drawn to clearly illustrate the connection between the various components in the embodiments, and are not intended to depict the actual sizes of the components.

In addition, terms used in the specification and the claims generally have the usual meaning as each terms are used in the field, in the context of the disclosure and in the context of the particular content unless particularly specified. Some terms used to describe the disclosure are to be discussed below or elsewhere in the specification to provide additional guidance related to the description of the disclosure to specialists in the art.

The phrases "first," "second," etc., are solely used to separate the descriptions of elements or operations with the same technical terms, and are not intended to convey a meaning of order or to limit the disclosure.

Additionally, the phrases "comprising," "includes," "provided," and the like, are all open-ended terms, i.e., meaning including but not limited to.

Further, as used herein, "a" and "the" can generally refer to one or more unless the context particularly specifies otherwise. It will be further understood that the phrases "comprising," "includes," "provided," and the like used herein indicate the stated characterization, region, integer, step, operation, element and/or component, and does not exclude additional one or more other characterizations, regions, integers, steps, operations, elements, components and/or groups thereof.

The heat spreaders are configured to be arranged on the component to conduct the heat generated by the component to exert the heat dissipation effect. For example, the heat spreader can be set on the components in the computer. In some embodiments, the heat spreader includes a flat metal sheet with recognizable stripes, such as QR code used for scanning. In some embodiments, the heat spreaders are contained in the container in a stacked manner. However, during transportation of the heat spreaders, frictions happened between the stacked heat spreaders, and the frictions damage the surface of the heat spreaders. To avoid such situation, in some embodiments of the present disclosure, gaskets are provided between the heat spreaders to avoid abrasion between the heat spreaders.

Figure 1A:
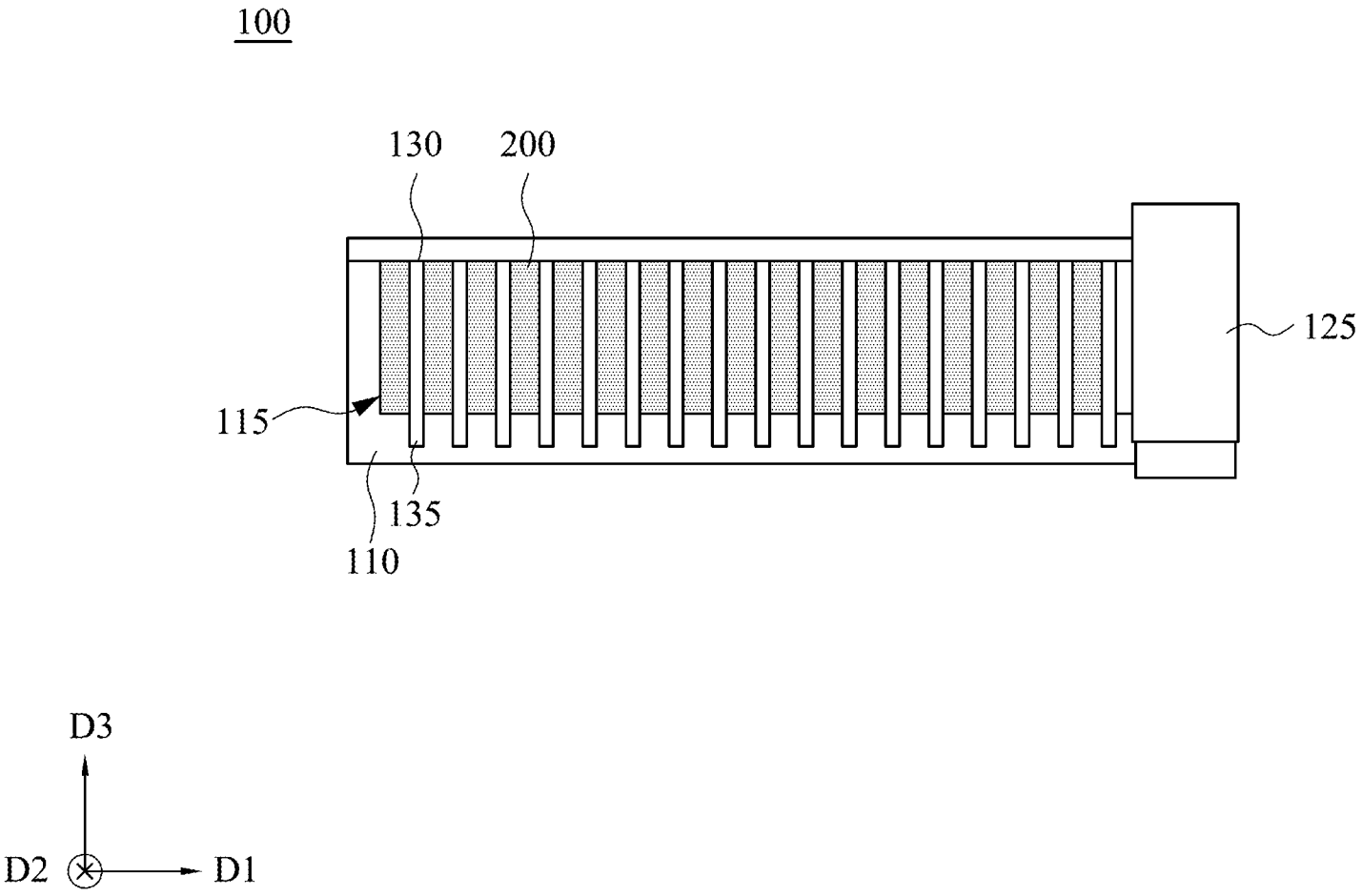
FIG. 1A illustrates a schematic top view of a packaging box according to one embodiment of the present disclosure.
Figure 1B:
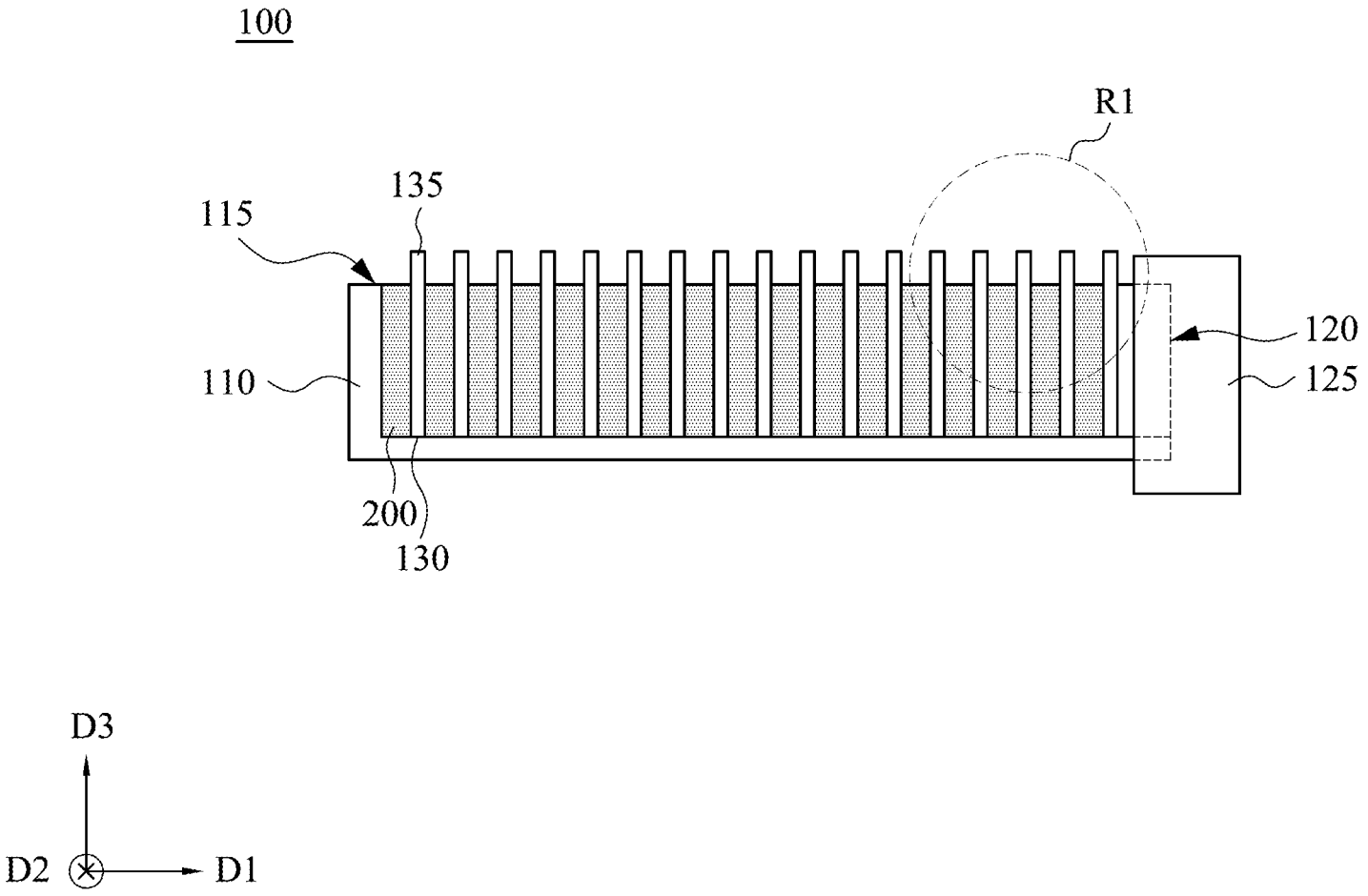
FIG. 1B illustrates a schematic side view of the packaging box of FIG. 1A.

Reference is made by FIGS. 1A and 1B. FIG. 1A illustrates a schematic top view of a packaging box 100 according to one embodiment of the present disclosure. FIG. 1B illustrates a schematic side view of the packaging box 100 of FIG. 1A.

As shown in FIGS. 1A and 1B, in this embodiment, the packaging box 100 is with a tube-shape. Specifically, in this embodiment, the packaging box 100 includes a container 110 and gaskets 130. The container 110 includes an opening 115, a removing port 120 and a cover 125. A plurality of the heat spreaders 200 is accommodated in the container 110 of the packaging box 100, and one of the gaskets 130 is located between and isolates any two immediate-adjacent heat spreaders 200. In other words, in this embodiment, the heat spreaders 200 and the gasket 130 are arranged alternately so that the heat spreaders 200 are entirely separated by the gaskets 130. In FIGS. 1A and 1B, the heat spreaders 200 and the gaskets 130 are arranged alternately along a direction D1. Therefore, direct contacts between the stacked heat spreaders 200 can be avoided, thereby avoiding the abrasion of the stacked heat spreaders 200 due to unexpected collisions with each other.

The heat spreaders 200 are exposed from the opening 115 of the container 110. As shown in the top view of FIG. 1A, in this embodiment, each gasket 130 has a handle portion 135 protruding from the heat spreader 200. Further, in this embodiment, the handle portions 135 of all the heat spreaders 200 protrude from the opening 115. Therefore, the gaskets 130 can be removed from the container 110 through the handle portion 135 at the same time, so that the heat spreaders 200 can be accommodated in the container 110 in a stacked manner.

Further, as indicated by the dotted line in FIG. 1B, in this embodiment, the container 110 includes the removing port 120, and the removing port 120 is closed by a cover 125. When the heat spreaders 200 are to be taken out of the container 110, the cover 125 can be removed and the removing port 120 can be opened, and the heat spreader 200 can be taken out from the container 110 through the removing port 120.

In some embodiments, the handle portions 135 of the gaskets 130 can be configured to protrude from the heat spreaders 200, but the handle portions 135 of the gaskets 130 are still kept from protruding from the container 110 and only exposed from the elongated opening 115 together. In such an embodiment, a housing can be further provided on the container 110 to cover the opening 115, and the housing is removed when the gaskets 130 needs to be taken out, so that all of the gaskets 130 can be removed from the container 110 through the handle portion 135.

For detail explanation, reference is made by FIG. 1C. FIG. 1C illustrates a schematic side view of the packaging box 100 of FIG. 1A from another angle. To simplify simple, the cover 125 is not illustrated in FIG. 1C.

FIG. 1C illustrates the view from the removing port 120 to the container 110. The heat spreaders 200 are contained in the container 110. The width W2 of the heat spreader 200 in the direction D2 is less than the width W1 of the opening 115 of the container 110. Each gasket 130 has the same width W1 as the opening 115. The handle portions 135 of the gaskets 130 protrude from the opening 115. Therefore, through the handle portions 135, the gaskets 130 in the container 110 can be taken out from the opening 115.

In this embodiment, the entire packaging box 100 can be regarded as a packaging tube. FIG. 1 B perspective depicts a partial outline of the elongated container 110 for accommodating the heat spreaders 200. FIG. 1C illustrates one end of the elongated tubular container 110 from the other side. The heat spreaders 200 are arranged in the elongated tubular container 110. The opening 115 is on a side of the container 110 and extends along the direction D1. The removing port 120 is located at one end of the elongated tubular container 110. Accordingly, the heat spreaders 200 are located in the elongated tubular container 110, and the gaskets 130 are inserted through the opening 115 on the side of the elongated tubular container 110 to isolate the heat spreaders 200 from each other. After the gaskets 130 are taken out from between the heat spreaders 200, the heat spreaders 200 can be taken out from the removing port 120 at the end of the elongated container 110.

Figure 3:
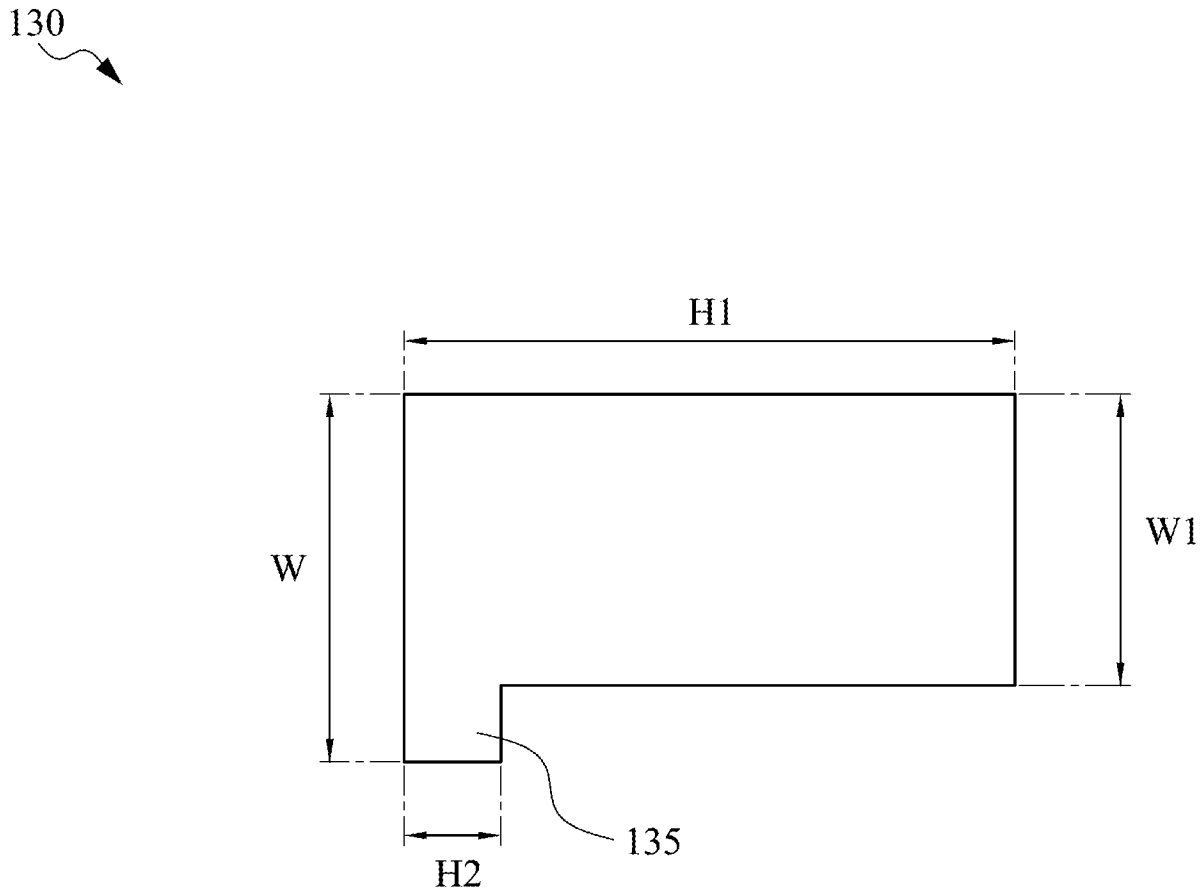
FIG. 3 illustrates a gasket according to one embodiment of the present disclosure.

Additionally, in this embodiment, as shown in FIG. 1C, the handle portion 135 protrudes from the opening 115 and further extends in the direction D2, so that the shape of the handle portion 135 L-shaped. Therefore, the width W (as shown in FIG. 3) of the handle portion 135 extending in the direction D2 is greater than the width W1 of the opening 115. The gaskets 130 can be taken out from the opening 115 along the direction D3 through the clamping part 135. For details, please refer to the following discussion.

As shown in FIG. 1C, the heat spreader 200 can only be inserted into or taken out of the container 110 through the removing port 120 since the width W2 of the heat spreader 200 is less than the width W1 of the opening 115. In some embodiments of the present disclosure, the gasket 130 can be inserted from the opening 115 first, and then the heat spreader 200 can be inserted from the removing port 120, so as to realize the staggered arrangement of the heat spreaders 200 and the gaskets 130. Such operations are repeated until the container 110 is filled with staggered heat spreaders 200 and gaskets 130, and then a cover 125 is placed to close the container 110. Therefore, the packaging box 100 containing the heat spreader 200 can be transported to the stage where the heat spreader 200 needs to be installed. Since the gaskets 130 are arranged between the heat spreaders 200, the problem of unexpected wear between the heat spreaders 200 during transportation can be improved.

Figure 2:
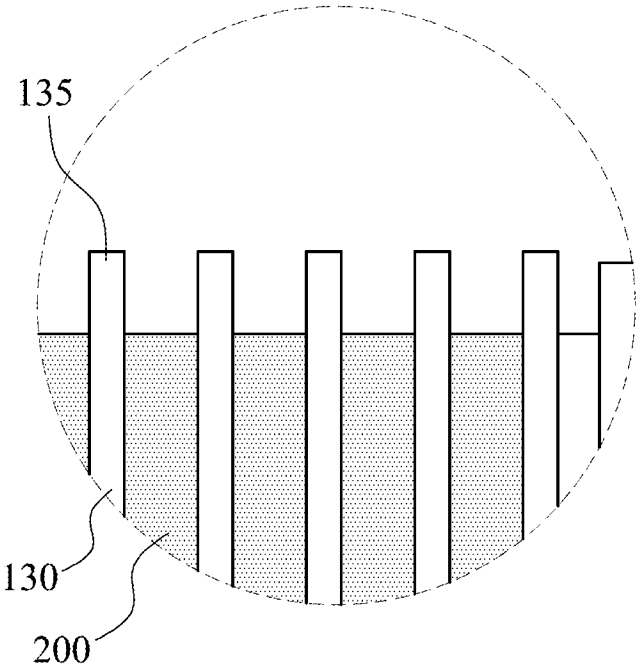
FIG. 2 illustrates a local region of the packaging box of FIG. 1B.

FIG. 2 illustrates a local region R1 of the packaging box of FIG. 1B. As shown in FIG. 2, the heat spreaders 200 in the container 110 are isolated from each other through the gaskets 130. The tops of the handle portions 135 of the gaskets 130 have different heights from the heat spreaders 200.

FIG. 3 illustrates a gasket 130 according to one embodiment of the present disclosure. In this embodiment, the gasket 130 has a protruding handle portion 135, which makes the gasket 130 L-shaped. The gasket 130 has a width W1, and the handle portion 135 of the gasket 130 has a width W. The width W of the handle portion 135 is greater than the width W1 of the gasket 130 located in the container 110. The gasket 130 has an overall thickness H1. The handle portion 135 of the gasket 130 has a thickness H2. In this embodiment, the thickness H1 is greater than the thickness H2, and the thickness H1 minus the thickness H2 should be greater than the height of the container 110 in the direction D2 to ensure that the handle portions 135 protrudes from the container 110.

Figure 4A:
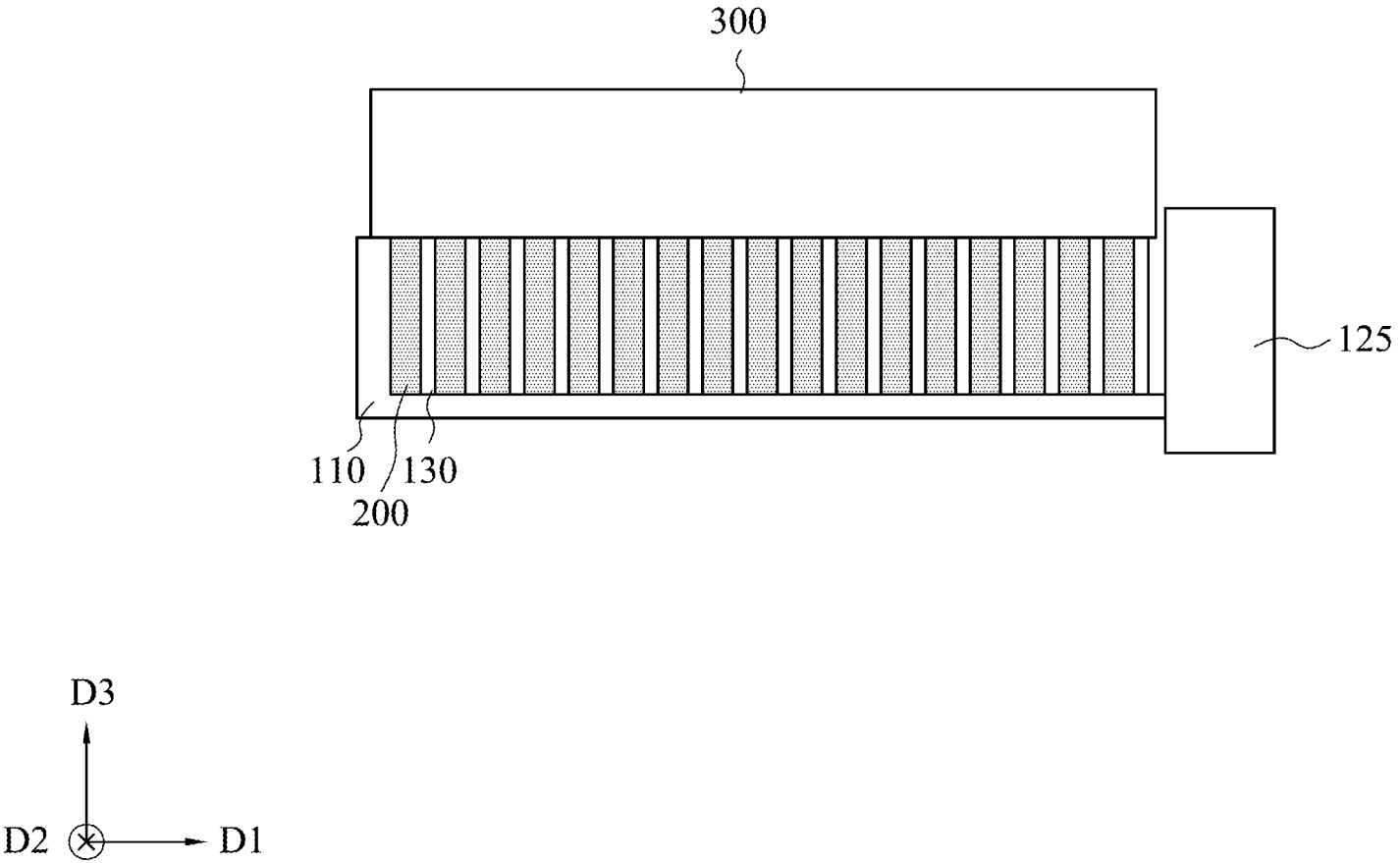
FIGS. 4A and 4B illustrates schematic side view of removing gaskets in different operations.
Figure 4B:
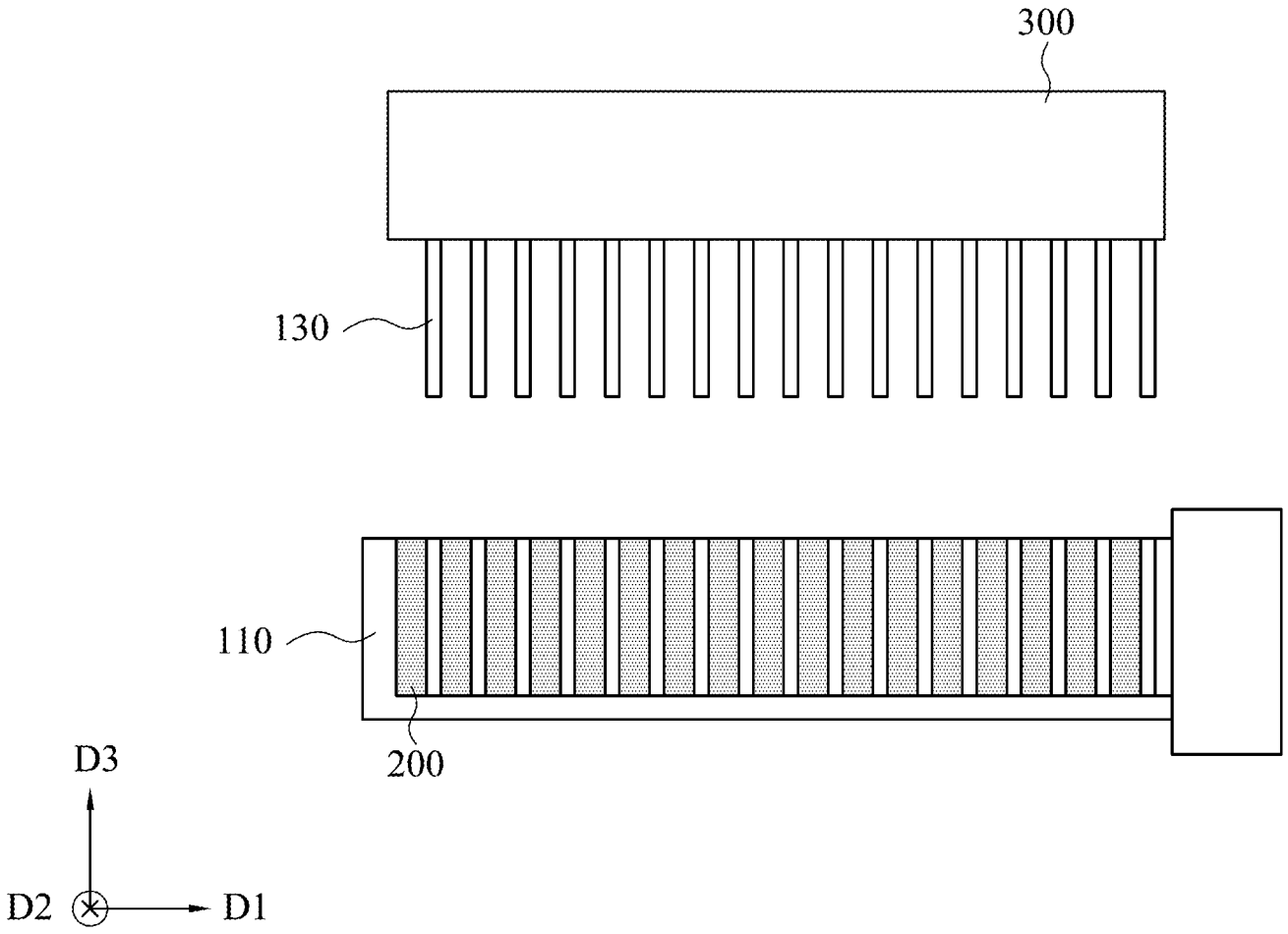
Figure 5B:
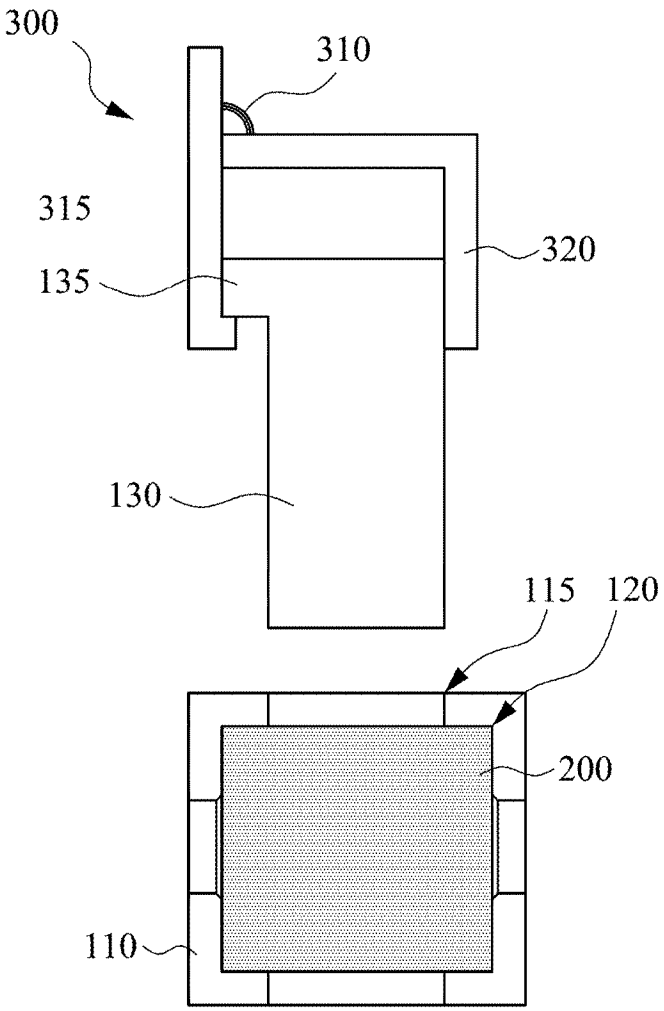
FIGS. 5A and 5B illustrates schematic side view of removing gaskets in different operations from another angle.
Figure 5A:
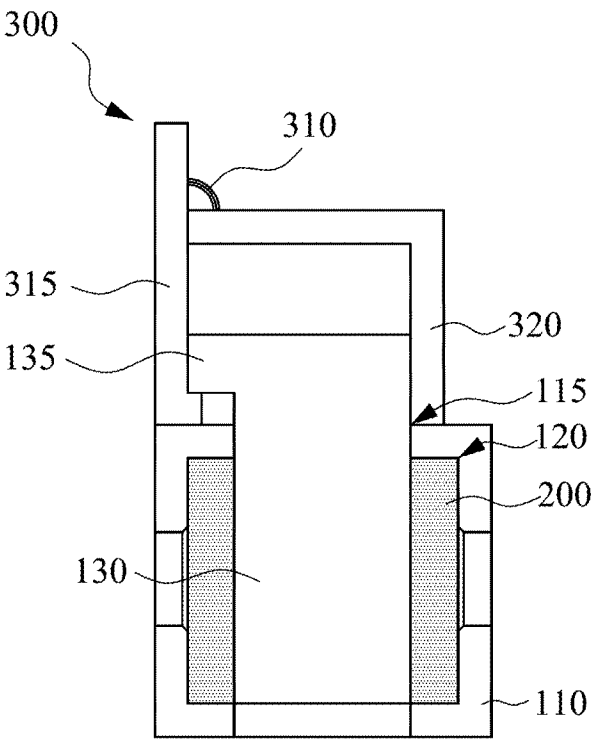

Reference is made by FIGS. 4A and 4B, and further refers to the corresponding FIGS. 5A and 5B. FIGS. 4A and 4B illustrates schematic side view of removing gaskets 130 in different operations. FIGS. 5A and 5B illustrates schematic side view of removing gaskets 130 in different operations from another angle. FIG. 4A is corresponding to FIG. 5A and FIG. 4B corresponding to FIG. 5B, so that the different operation of a packaging method of one embodiment in the present disclosure can be presented.

As shown in FIGS. 1A-1C, after the heat spreaders 200 and the gaskets 130 are arranged alternately, the heat spreaders 200 can be safely transported without worrying about the unintended wear of the heat spreaders 200. After the heat spreaders 200 are transported to the destination, the gaskets 130 should be taken out at the same time to save time and return the heat spreaders 200 to the normal stacking condition. To achieve the normal stacking condition, please refer to FIG. 4A and FIG. 5A at the same time.

As shown in FIG. 4A and FIG. 5A, the gaskets 130 can be removed from the container 110 through a clamp 300. Specifically, in this embodiment, the clamp 130 includes a hook 315 and a hook 320. The hook 315 and the hook 320 are connected to each other by a spring 310. The hook 315 and the hook 320 simultaneously clamp the handle portions 135 of the gaskets 130.

Proceed to FIG. 4B and FIG. 5B. After the hook 315 and the hook 320 clamp the handle portions 135 of the gaskets 130 at the same time, the clamp 300 moves upward, and all the gaskets 130 can be taken out of the container 110 at one time. Therefore, the heat spreaders 200 can be taken out from the removing port 120 without being hindered by the gaskets 130.

Taking out the gaskets 130 at the same time not only saves time but also can be directly applied to some existing installation operations of stacked arrangement for the heat spreaders 200. For example, in some embodiments, after the gaskets 130 are taken out from the container 110, the container 110 containing the stacked heat spreaders 200 can be directly configured on the machine where the heat spreaders 200 are installed. The heat spreaders 200 are pushed and installed one by one on the components to be dissipated.

It should be noted that the number of heat spreaders 200 shown in the above drawings is only for illustration, and the number of heat spreaders 200 of the present disclosure is not limited by this embodiment. In addition, the thicknesses of the heat spreaders 200 and the gasket 130 shown in the above drawings are only for illustration, and this disclosure is not limited by this embodiment.

Figure 6:
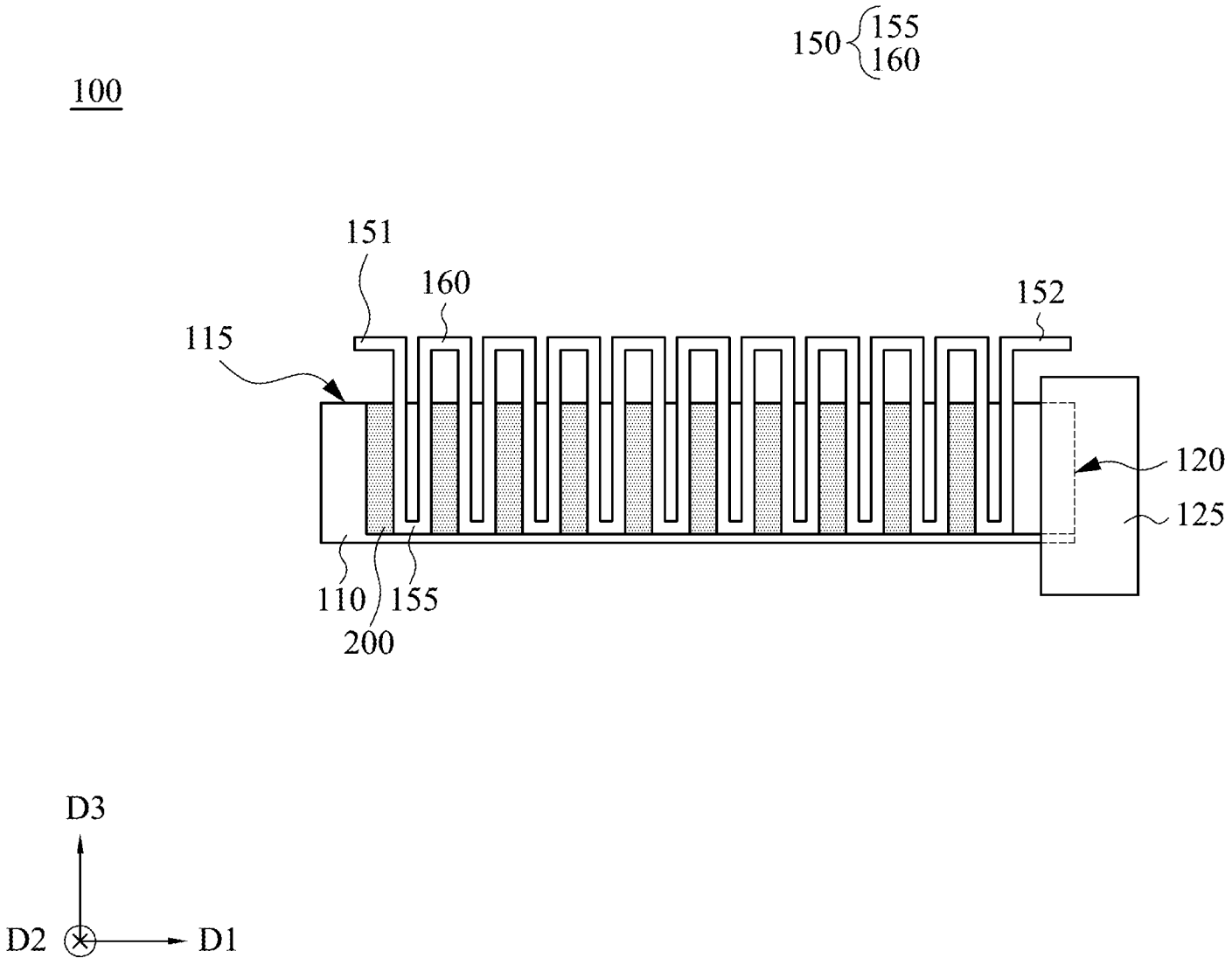
FIG. 6 illustrates a side view of a packaging box according to one embodiment of the present disclosure.

FIG. 6 illustrates a side view of a packaging box 100' according to one embodiment of the present disclosure. The difference between the packaging box 100' of FIG. 6 and the packaging box 100 of FIG. 1B is that the plurality of the gaskets 155 in the packaging box 100' of FIG. 6 is connected to each other.

As shown in FIG. 6, the packaging box 100' includes a container 110 and a spacer 150. The container 110 includes an opening 115, a removing port 120 and a cover 125. The heat spreaders 200 are located in the container 110. One of the gaskets 155 of the spacer 150 is configured between two immediately-adjacent two of the heat spreaders 200.

In detail, in the packaging box 100', the spacer 150 includes a plurality of gaskets 155 and connecting portions 160. The gaskets 155 are connected to each other through the connecting portion 160 to form the unitary spacer 150.

Compared with the gasket 130 of the packaging box 100 in FIG. 1B, in the packaging box 100', each gasket 155 is with U-shaped, and the two sides of the U-shaped gasket 155 are adjacent and connected to one of the heat spreaders 200. The bottom of the U-shaped gasket 155 is in contact with the bottom of the container 110. Therefore, the spacer 150 is integrally formed by the U-shaped gaskets 155 and the connecting portions 160 extended across the heat spreaders 200.

In this case, all the gaskets 155 in the container 110 can be taken out at the same time without using a clamp.

Figure 7:
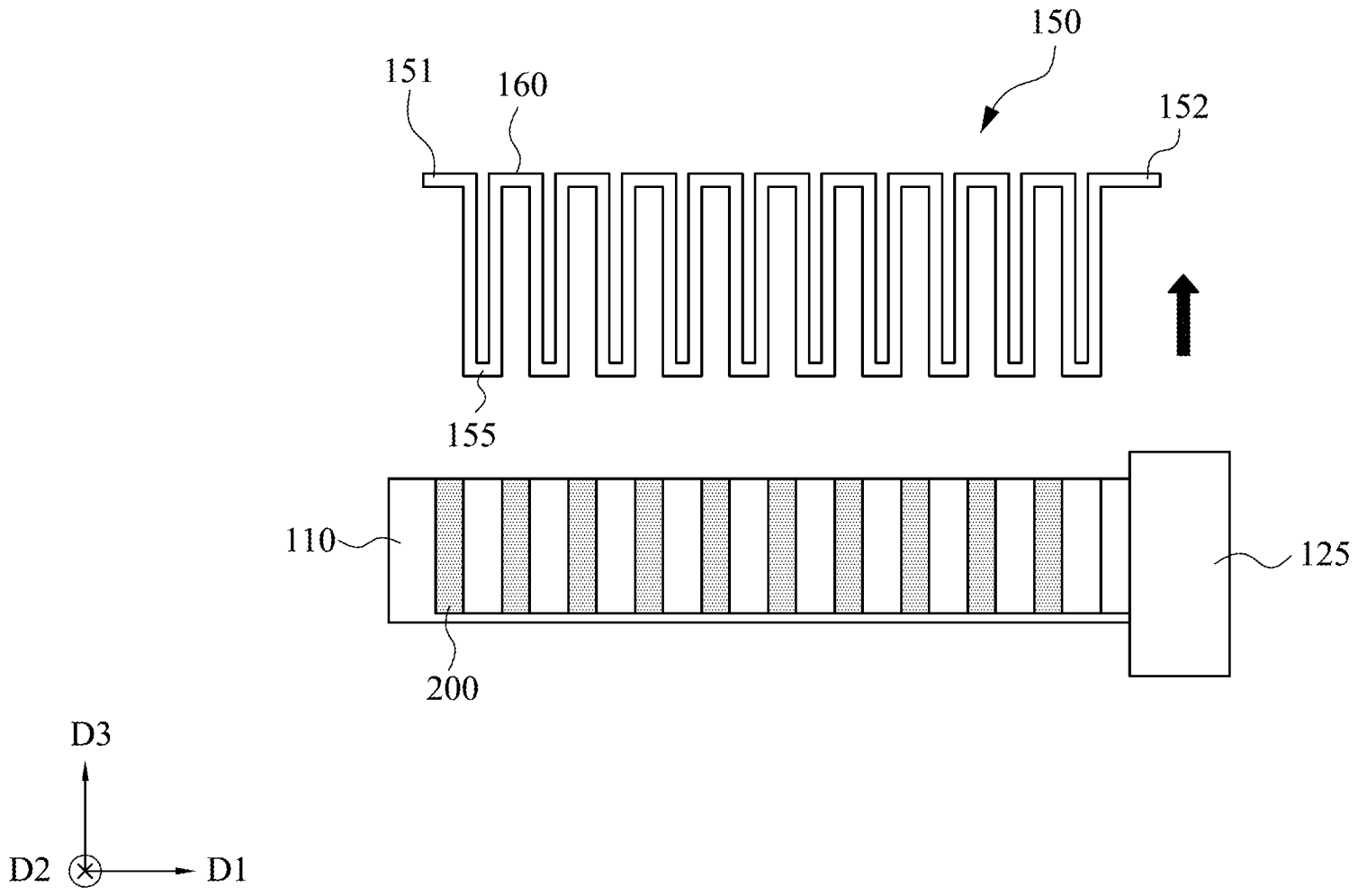
FIG. 7 illustrates a schematic side view of removing the gaskets from the packaging box.

Reference is made by FIG. 7. FIG. 7 illustrates a schematic side view of removing the gaskets 130 from the packaging box 100'. Specifically, the gaskets 155 integrally forming the spacer 150 are taken out from the opening of the container 110 together to move the spacer 150 in the direction D3. In this embodiment, the direction D3 is perpendicular to the direction D1 in which the heat spreaders 200 and the gaskets 155 are alternately arranged.

For example, please refer to FIGS. 6 and 7 at the same time. The spacer 150 has a first end 151 and a second end 152 protruding from the opening 115. In some embodiments, to take out the gaskets 155 of the spacer 150 together, only by applying force to the first end 151 and the second end 152. Therefore, the entire spacer 150 can be moved along the direction D3, and all the gaskets 155 are removed from between the heat spreaders 200 at the same time. Accordingly, the heat spreaders 200 in container 110 can be arranged in a stacked manner.

Figure 8:
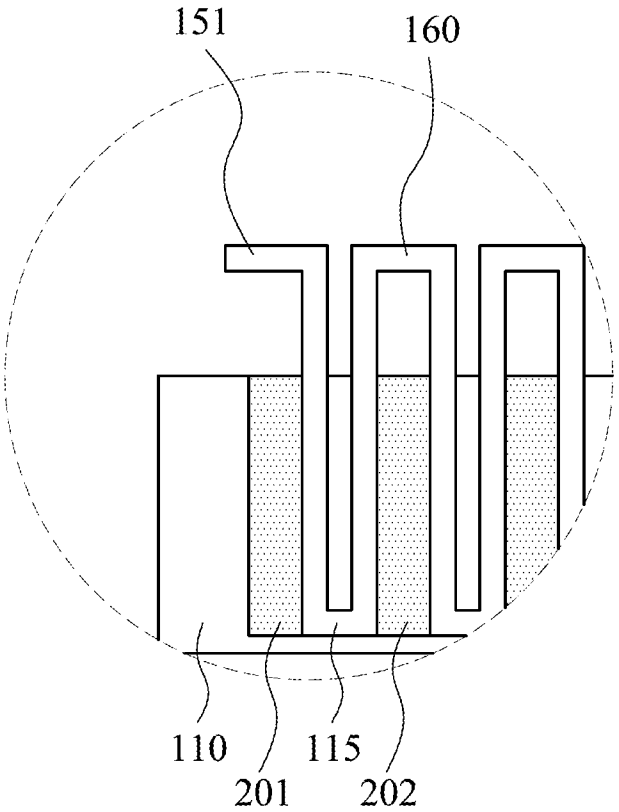
FIG. 8 illustrates a local region of the packaging box of FIG. 6.

FIG. 8 illustrates a local region of the packaging box 100' of FIG. 6. Reference is made by FIGS. 6 and 8. The heat spreaders 200 include a first heat spreader 201 and a second heat spreader 202, and a U-shaped gasket 155 is located between the first heat spreader 201 and the second spreader 202. The gaskets 155 connected to each other through the connecting portions 160 across the heat spreaders 200 (e.g. the second heat spreader 202) to form the spacer 150. The first end 151 of the spacer 150 protrudes from the container 110.

As shown in FIGS. 6 and 8, in this embodiment, spacing is between the connecting portions 160 of the spacer 150 and the heat spreaders 200 in direction D3. The spacing is left because of the convenience of the manufacturing process. In some embodiments, the spacing between the connecting portions 160 of the spacer 150 and the heat spreaders 200 in direction D3 can be vanished, so that the connecting portions 160 can be close to the heat spreaders 200.

Figure 9:
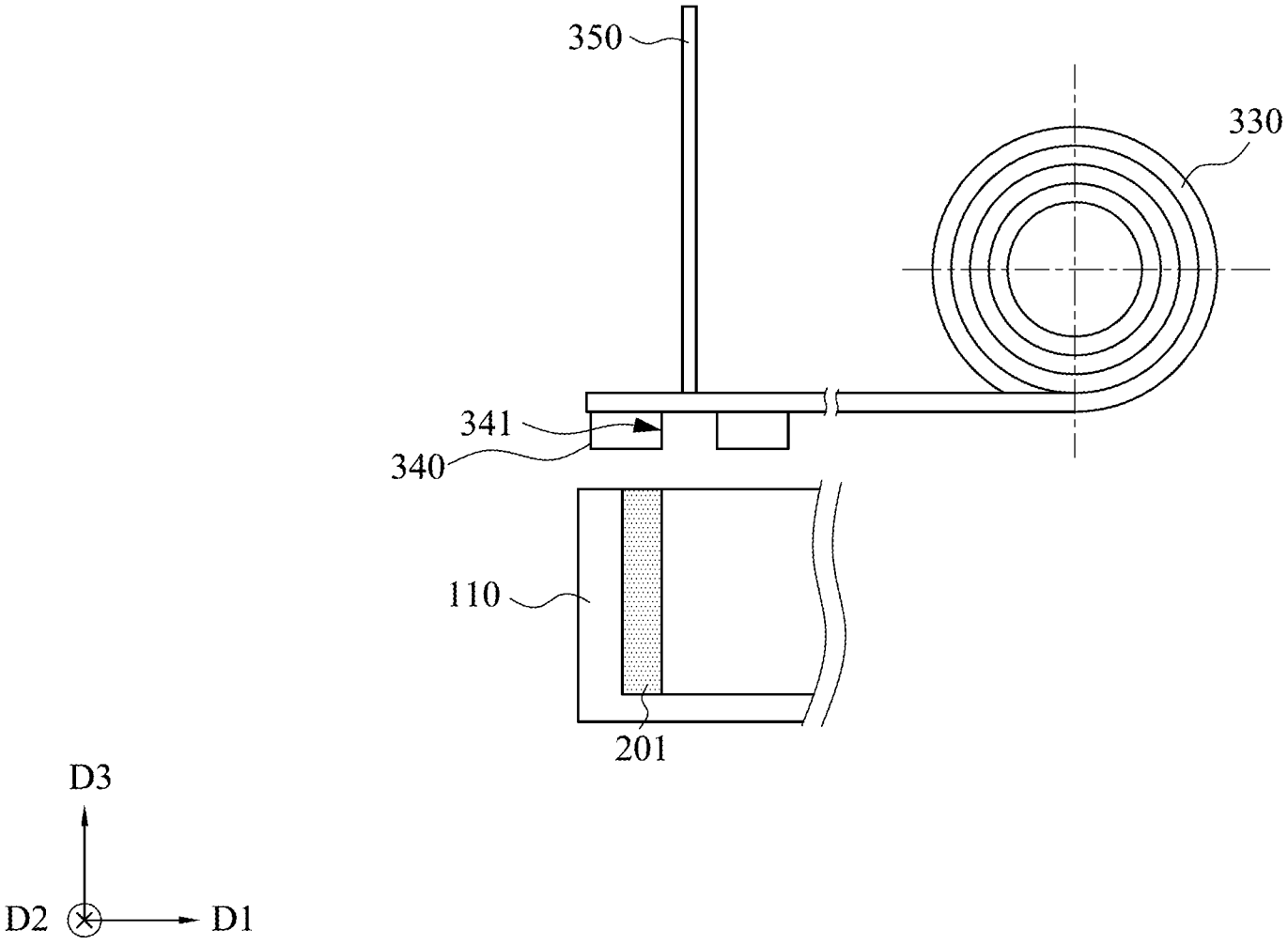
FIGS. 9, 10 and 11 illustrate side views of placing gaskets in different operations of a packaging method according to one embodiment of the present disclosure.
Figure 10:
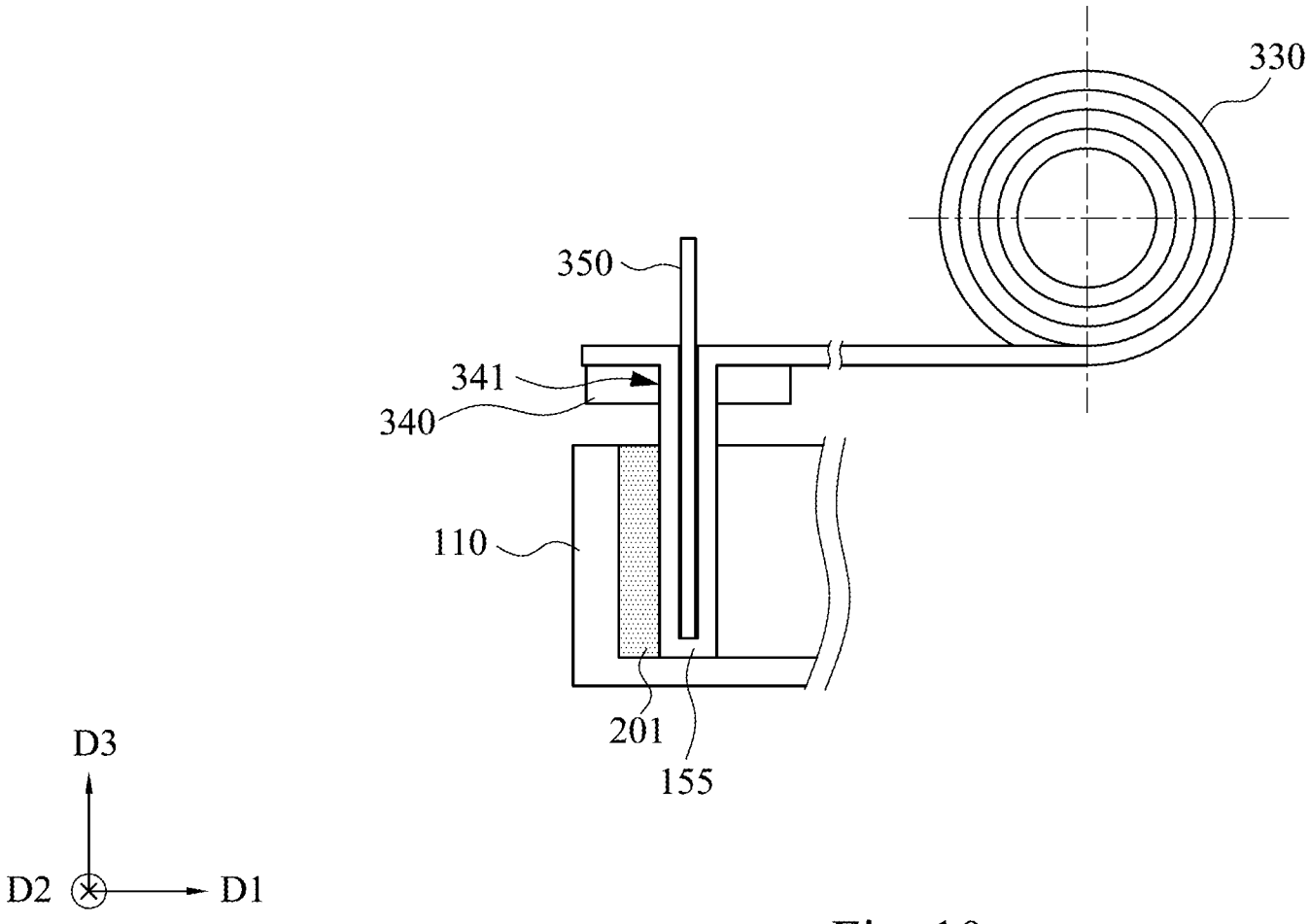
Figure 11:
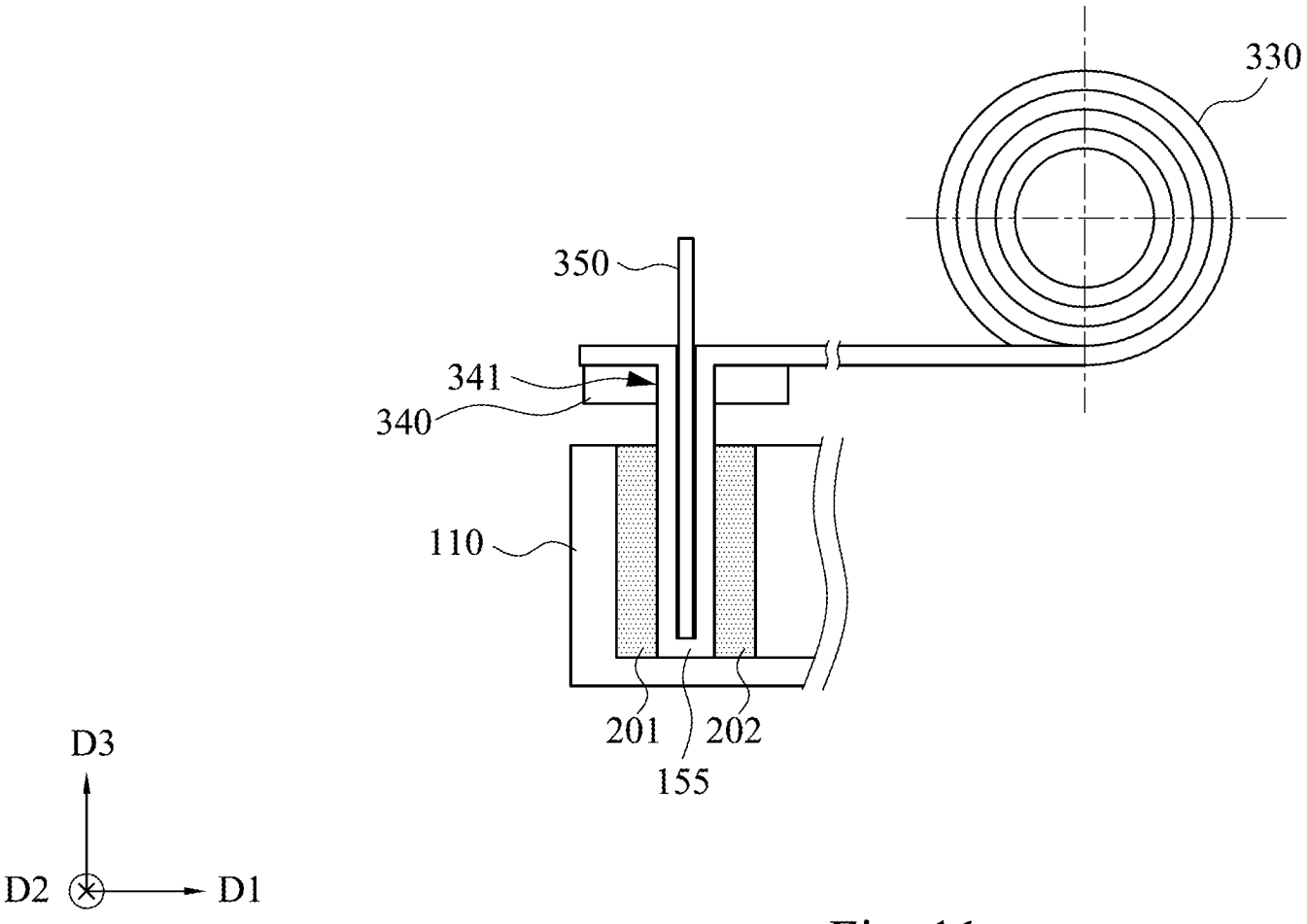

Reference is made by FIGS. 9, 10 and 11. FIGS. 9, 10 and 11 illustrate side views of placing gaskets in different operations of a packaging method according to one embodiment of the present disclosure.

As shown in FIG. 9, after a container 110 of the packaging box 100' is provided, a first heat spreader 201 of the heat spreader 200 is configured in the container 110. The first heat spreader 201 is against the side of container 110.

Subsequently, as shown in FIG. 9, an extending portion 330 is provided. The width of the extending portion 330 in the direction D2 is less than or equal to the width W1 of the opening 115 in the direction D2 (as shown in FIG. 1C). In addition, a gate 340 is configured between the extending portion 330 and the container 110, and the molding hole 341 of the gate 340 is aligned with one side of the first heat spreader 201 of the heat spreaders 200. A distance between the extending portion 330 and the container 110 is provided to place the gate 340. On the other hand, the pushing tool 350 is configured on the other side of the extending portion 330 opposite to the gate 340. The pushing tool 350 is aligned with the molding hole 341 of the gate 340.

Proceed to FIG. 10. In FIG. 10, the pushing tool 350 moves toward the container 110 and then pushes the part of the extending portion 330 into the container 110 to form a U-shaped gasket 155. One side of the U-shaped gasket 155 abuts against the first heat spreader 201. The bottom of the U-shaped gasket 155 is contacted to the bottom of the container 110.

Proceed to FIG. 11 after the gasket 155 is formed, a second heat spreader 202 of the heat spreader 200 is configured in the container 110 and connected to the other side of the U-shaped gasket 155. Therefore, the U-shaped gasket 155 is substantially located between the closest first heat spreader 201 and the second heat spreader 202. In some embodiments, after the U-shaped gasket 155 is formed, the second heat spreader 202 can be inserted through the removing port 120 of the container 110 (as shown in FIG. 6) from the direction D1.

After completing the setting of the second heat spreader 202 in FIG. 11, the pushing tool 350 can be removed from the formed U-shaped gasket 155 and then exit the gate 340 from the direction D2. Subsequently, repeating operations in FIGS. 9 to 11 again, another U-shaped gasket 155 can be formed on the other side of the second heat spreader 202, and other heat spreaders 200 are inserted into the container 110. Repeat the operations of FIGS. 9-11 to alternately arrange the U-shaped gasket 155 and the heat spreaders 200 until the container 110 is filled. Finally, the part of the extending portion 330 outside the container 110 is disconnected and removed, so that the part of the extending portion 330 remaining in the container 110 and located between the heat spreaders 200 can be regarded as the gaskets 155 and form a unitary spacer 150 shown in FIG. 6.

Therefore, as shown in FIG. 6, the formed U-shaped gaskets 155 are connected to each other through the connecting portions 160 across the heat spreaders 200 to form a integrally spacer 150. The spacer 150 has a first end 151 and a second end 152 protruding from the container 110, so that the gaskets 155 of the spacer 150 can be removed from the container 110 at the same time without using additional clamps.

It should be noted that the number of heat spreaders 200 shown in the above drawings is only for illustration, and the number of heat spreaders 200 of the present disclosure is not limited by this embodiment. In addition, the thicknesses of the heat spreaders 200 and the gaskets 155 of the spacer 150 are shown in the above drawings, which are only for illustration, and the present disclosure is not limited by this embodiment.

In some embodiments, material of the extending portion 330 includes web, which can be a long, thin, and flexible material.

In summary, the present disclosure provides packaging boxes and corresponding packaging methods. The gaskets for the heat spreader are arranged in the container to avoid unexpected wear between stacked heat spreaders during transportation. In addition, the gaskets between the heat spreaders are designed to be able to be removed at the same time, so that the heat spreaders can return to the conventional stacked configuration, and some existing installation methods can be used to install the stacked heat spreaders on component to be dissipated. In some embodiments, the gaskets are further designed to be integrally formed, so that the gaskets can be removed from between the heat spreaders at the same time without using additional clamps.

Although the present disclosure has been described in considerable detail with reference to certain embodiments thereof, other embodiments are possible. Therefore, the spirit and scope of the appended claims should not be limited to the description of the embodiments contained herein. In view of the foregoing, it is intended that the present disclosure cover modifications and variations of this disclosure provided they fall within the scope of the following claims.

What is claimed is:

1. A packaging method of heat spreaders, comprising:

arranging a plurality of heat spreaders and a plurality of gaskets alternately to a container, wherein at least one of the gaskets is arranged between any immediately-adjacent two of the heat spreaders so that the heat spreaders are entirely separated by the gaskets; and removing all of the gaskets from the container at the same time such that the heat spreaders are accommodated in the container in a stacked manner after all of the gaskets are removed from the container.

2. The packaging method of claim 1, wherein the gaskets are connected to each other to form a unitary spacer.

3. The packaging method of claim 2, wherein arranging the heat spreaders and the gaskets alternately to the container further comprises:

placing a first heat spreader of the heat spreaders to the container;

providing an extending portion, wherein a part of the extending portion is aligned with and pushed into an adjacent space near the first heat spreader to form a first gasket of the gaskets, and the part of the extending portion is a part of the unitary spacer; and placing a second heat spreader of the heat spreaders to the container.

4. The packaging method of claim 3, wherein the unitary spacer has opposite two ends protruding from the container, removing all of the gaskets from the container at the same time further comprises:

removing the unitary spacer through the two ends at the same time, such that the gaskets leave from the heat spreaders at the same time.

5. The packaging method of claim 1, wherein the container further comprises an opening and a removing port, handle portions of the gaskets protrude from the container through the opening, and the packaging method further comprises:

removing the heat spreaders from the removing port after all of the gaskets are removed from the container through the opening.

6. The packaging method of claim 1, wherein all of the gaskets are removed from the container by clamping handle portions of the gaskets higher than the heat spreaders.

7. The packaging method of claim 1, wherein the heat spreaders are flat metal sheets.

8. The packaging method of claim 1, wherein each of the gaskets has a U-shaped portion having two sides respectively connected to immediately-adjacent two of the heat spreaders after the heat spreaders and the gaskets are arranged in the container.

9. The packaging method of claim 1, wherein all of the gaskets are removed from the container in a first direction different from a second direction in which the heat spreaders are arranged in the stacked manner in the container.

* * * * *